US010524972B2

(12) United States Patent
Amundson et al.

(10) Patent No.: US 10,524,972 B2
(45) Date of Patent: Jan. 7, 2020

(54) MACHINE TO HUMAN INTERFACES FOR COMMUNICATION FROM A LOWER EXTREMITY ORTHOTIC

(71) Applicant: Ekso Bionics, Inc., Richmond, CA (US)

(72) Inventors: Kurt Amundson, Berkeley, CA (US); Nathan Harding, Oakland, CA (US); Russdon Angold, American Canyon, CA (US); Adam Zoss, Berkeley, CA (US)

(73) Assignee: Ekso Bionics, Inc., Richmond, CA (US)

( * ) Notice: Subject to any disclaimer, the term of this patent is extended or adjusted under 35 U.S.C. 154(b) by 834 days.

(21) Appl. No.: 15/033,220

(22) PCT Filed: Nov. 12, 2014

(86) PCT No.: PCT/US2014/065142
§ 371 (c)(1),
(2) Date: Apr. 29, 2016

(87) PCT Pub. No.: WO2015/073490
PCT Pub. Date: May 21, 2015

(65) Prior Publication Data

US 2016/0250094 A1 Sep. 1, 2016

Related U.S. Application Data

(60) Provisional application No. 61/903,087, filed on Nov. 12, 2013.

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 1/0244* (2013.01); *A61H 1/0262* (2013.01); *A61H 1/0266* (2013.01); *A61H 2003/007* (2013.01); *A61H 2201/1215* (2013.01); *A61H 2201/165* (2013.01); *A61H 2201/1628* (2013.01);
(Continued)

(58) Field of Classification Search
CPC ..... A61H 3/00; A61H 1/0262; A61H 1/0244; A61H 1/024
See application file for complete search history.

(56) References Cited

U.S. PATENT DOCUMENTS

| | | | |
|---|---|---|---|
| 2,107,095 | A | 2/1938 | Wagner |
| 2,573,866 | A | 11/1951 | Murphy |
| 3,449,769 | A | 6/1969 | Mizen |

(Continued)

FOREIGN PATENT DOCUMENTS

| | | |
|---|---|---|
| CN | 202173562 | 3/2012 |
| JP | 2008068046 | 3/2008 |
| WO | WO 2011/127421 | 10/2011 |

*Primary Examiner* — Marcia L Watkins
(74) *Attorney, Agent, or Firm* — Diederiks & Whitelaw, PLC.

(57) ABSTRACT

A lower extremity orthosis is configured to be coupled to across at least one joint of a person for gait assistance and can incorporate knee, thigh, hip and ankle/foot assistive orthotic devices which can be used in various combinations to aid in the rehabilitation and restoration of muscular function in patients with impaired muscular function or control.

30 Claims, 13 Drawing Sheets

(52) U.S. Cl.
CPC ..... *A61H 2201/1642* (2013.01); *A61H 2201/5061* (2013.01); *A61H 2201/5084* (2013.01)

(56) References Cited

U.S. PATENT DOCUMENTS

| | | | |
|---|---|---|---|
| 4,243,027 | A | 1/1981 | Lacourse |
| 4,543,948 | A | 10/1985 | Phillips et al. |
| 4,688,559 | A | 8/1987 | Vito et al. |
| 4,697,808 | A | 10/1987 | Larson et al. |
| 4,964,628 | A | 10/1990 | Poplawski |
| 4,969,452 | A | 11/1990 | Petrofsky et al. |
| 5,020,790 | A | 6/1991 | Beard et al. |
| 5,282,460 | A | 2/1994 | Boldt |
| 5,362,305 | A | 11/1994 | Varn |
| 5,814,001 | A | 9/1998 | Schwenn et al. |
| 6,045,521 | A | 4/2000 | Saitoh et al. |
| 6,146,341 | A | 11/2000 | Sato et al. |
| 6,783,555 | B2 | 8/2004 | Kuhn et al. |
| 6,824,569 | B2 | 11/2004 | Okediji |
| 7,524,297 | B2 | 4/2009 | Shimada et al. |
| 7,597,672 | B2 | 10/2009 | Kruijsen et al. |
| 7,828,755 | B2 | 11/2010 | Ikeuchi |
| 8,235,924 | B2 | 8/2012 | Bachmann et al. |
| 8,251,930 | B2 | 8/2012 | Ido |
| 8,523,790 | B2 | 9/2013 | Matsuoka et al. |
| 8,551,184 | B1 | 10/2013 | Herr |
| 8,597,369 | B2 | 12/2013 | Hansen et al. |
| 8,622,938 | B2 | 1/2014 | Sankai |
| 8,690,801 | B2 | 4/2014 | Nakashima et al. |
| 8,702,632 | B2 | 4/2014 | Han et al. |
| 8,773,148 | B2 | 7/2014 | Sankai et al. |
| 8,801,641 | B2 | 8/2014 | Kazerooni et al. |
| 8,986,233 | B2 | 3/2015 | Aoki et al. |
| 9,168,195 | B2 | 10/2015 | Sankai |
| 9,693,926 | B2 | 7/2017 | Goldfarb et al. |
| 2006/0064047 | A1 | 3/2006 | Shimada et al. |
| 2006/0211967 | A1 | 9/2006 | Reynolds et al. |
| 2006/0260620 | A1 | 11/2006 | Kazerooni et al. |
| 2007/0123997 | A1 | 5/2007 | Herr et al. |
| 2009/0292369 | A1 | 11/2009 | Kazerooni et al. |
| 2010/0174384 | A1 | 7/2010 | Herr et al. |
| 2010/0286796 | A1 | 11/2010 | Clausen |
| 2011/0040216 | A1 | 2/2011 | Herr et al. |
| 2012/0271207 | A1 | 10/2012 | Schoen et al. |
| 2014/0100492 | A1 | 4/2014 | Nagasaka |
| 2014/0276262 | A1 | 9/2014 | Kare et al. |
| 2016/0310344 | A1* | 10/2016 | Shimada ..... A61H 3/00 |

* cited by examiner

MACHINE TO HUMAN INTERFACES FOR COMMUNICATION FROM A LOWER EXTREMITY ORTHOTIC

CROSS-REFERENCE TO RELATED APPLICATIONS

The present application represents a National Stage application of PCT/US2014/065142 entitled "Machine to Human Interfaces for Communication from a Lower Extremity Orthotic" filed Nov. 12, 2014, pending, which claims the benefit of U.S. Provisional Application Ser. No. 61/903,087 filed Nov. 12, 2013 entitled "Orthoses for Gait Assistance".

BACKGROUND OF THE INVENTION

The present invention relates to orthotic devices that aid in the rehabilitation and restoration of muscular function in patients with impaired muscular function or control. More particularly, the present invention relates to orthotic devices and configurations of these orthotic devices suitable for therapeutic use with patients that have impaired neuromuscular/muscular function of the appendages, including, but not limited to, orthotic devices including of a motorized system of braces and related control systems that potentiate improved function of the appendages for activities such as walking.

Millions of individuals suffer from either partial or total loss of walking ability, resulting in greatly impaired mobility for the afflicted individual. This disabled state can result from traumatic injury, stroke, or other medical conditions that cause disorders that affect muscular control. Regardless of origin, the onset and continuance of walking impairment can result in additional negative physical and/or psychological outcomes for the stricken individual. In order to improve the health and quality of life of patients with walking impairment, the development of devices and methods that can improve or restore walking function is of significant utility to the medical and therapeutic communities. Beyond walking impairment, there are a range of medical conditions that interfere with muscular control of the appendages, resulting in loss of function and other adverse conditions for the affected individual. The development of devices and methods to improve or restore these additional functions is also of great interest to the medical and therapeutic communities.

Human exoskeleton devices are being developed in the medical field to restore and rehabilitate proper muscle function for people with disorders that affect muscle control. These exoskeleton devices can be represented as a system of motorized braces that can apply forces to the wearer's appendages. In a rehabilitation setting, exoskeletons are controlled by a physical therapist and/or the patient wearing the exoskeleton who uses one of a plurality of possible inputs to command an exoskeleton control system. In turn, the exoskeleton control system actuates the position of the motorized braces, resulting in the application of force to, and typically movement of, the body of the exoskeleton wearer.

Exoskeleton control systems prescribe and control trajectories in the joints of an exoskeleton. These trajectories can be prescribed as position based, force based, or a combination of both methodologies, such as those seen in an impedance controller. Position based control systems can modify exoskeleton trajectories directly through modification of the prescribed positions. Force based control systems can modify exoskeleton trajectories through modification of the prescribed force profiles. Complicated exoskeleton movements, such as walking, are commanded by an exoskeleton control system through the use of a series of exoskeleton trajectories, with increasingly complicated exoskeleton movements requiring an increasingly complicated series of exoskeleton trajectories. These series of trajectories may be cyclic, such as the exoskeleton taking a series of steps with each leg, or they may be discrete, such as an exoskeleton rising from a seated position into a standing position.

Depending on the particular physiology or rehabilitation stage of a patient, different degrees of assistance must be provided by the exoskeleton in various motions required for walking. For some patients, such as paraplegics, the actuators of a modern exoskeleton must provide all of the force required for walking. However, in some applications where a patient has some function, it may be sufficient to simply provide a push in the correct direction at the correct position in the gait cycle. This sort of locomotion assistance can be likened to pushing a child on a swing: the push provided need not be precise as long as it is neither so small that motion of the swing decays nor so large that the motion of the swing becomes unstable. Thus, it is possible for an exoskeleton to facilitate the walking of a patient by simply providing some assistance at a key portion of the gait cycle.

In people who have limited use of their lower limbs, restoring the function of the knee is critical to the restoration of standing or walking function because the leg cannot bear weight without a functioning knee. This is made clear within the field of prosthetics where the greatest effort and complexity of design is dedicated to the design of knee prostheses. Historically, knee prostheses were the first to incorporate microprocessors and later powered actuators as well. In the field of orthotics, conventional mechanical devices include braces that lock when the knee is straight and unlock in later stance so that the person can bend their knee during swing; these devices have been available for decades, although recent advances have rendered them smaller and more reliable. Newer orthotics, like prosthetics, have come to include microprocessors which allow for greater robustness to variable conditions. For example, in a traditional, purely mechanical orthosis, locking the knee for stance is triggered by reaching full knee extension in terminal swing. However, it may be desirable for the knee to lock in terminal swing even if the knee extension is not full, by using other markers such as looking for impact with the support surface using an accelerometer. Such behaviors are extremely difficult to design mechanically, but can be trivial to implement with a microprocessor. There are many examples of such devices known to the art, some of which are available for sale.

Existing knee orthosis devices have many shortcomings. Firstly, a stance control knee brace cannot provide active assistance to help a person go from sitting to standing. Some devices have the ability to power a person's gait. That is, in addition to having a microprocessor that can lock the knee at a fixed position, the device also has an actuator large enough to transfer mechanical power into the person's gait. The additional complexity required is non-trivial: the only actuation systems practical are electric motors using large (typically around 1:100) transmission ratios that convert the high speed, low torque motion of the motor into high torque, low speed motion needed for human locomotion. In some devices, this transmission is a ball screw device; in others a harmonic drive; and in others a hydraulic pump and cylinder. In all cases, there is a common difficulty besides the actuation, in that the device must be coupled to the person. Superficially, this may not appear to be a limiting factor since so many unpowered stance control knee braces have been designed, but in fact there is an important difference. Stance controlled knee braces are designed only to support body weight when the knee is nearly straight; in this situation, the torque resisted by the device is small. Powered knee braces can provide torque even when the knee angle is large, and are designed to produce very large torques often similar to those produced by the human body. In these cases, attempting to couple to the person is not a trivial problem, as the large torque generated by the device at the knee must be resolved through the person-device connection at both the thigh and the shank. This connection is typically soft, so as not to injure the person, and, as a result, applying high torque results in undesirable person-device motion. With this in mind, there exists an unmet need to provide a device by which a powered knee brace can exert sufficiently large forces on the knee of the person coupled to the knee brace so as to affect walking by the person coupled to the knee brace, while simultaneously decreasing relative motion between the person and the knee brace device. This device must also do so without producing undue discomfort or awkwardness to the patient coupled to the device.

An orthotic device with a powered knee brace alone can neither assist in the swinging of the leg, nor in the propulsion of the body during stance. Biomechanically, the hip plays a role in both functions, helping propel the person during stance and throw the leg forward during swing. While devices have been proposed to aid with the hip motion of the person during walking, these devices are cumbersome because they require high power actuation and/or close anthropomorphic coupling to the person. The human hip is a three degree of freedom joint, allowing motion in all three rotational axes; and while high powers for walking are required only in the sagittal plane, unpowered degrees of freedom must often be provided in the other axes in order to allow for normal walking. Some devices approximate these degrees of freedom with complex mechanisms, and others simply lock out these degrees of freedom, constraining the person. Therefore, an unmet need also exists to provide an orthotic hip device that allows assistance of leg movement in swing and propulsion of the body in stance, but without restricting degrees of freedom about the hip or requiring overly complicated, bulky, heavy mechanisms.

For some persons suffering from lower extremity weakness (often, but not always, post stroke), preventing foot drop is important, because otherwise the person may drag their toe on the ground, stumble, and fall. Therefore, an unmet need further exists to provide a device that is able to reliably lift the toe for the person during swing.

SUMMARY OF THE INVENTION

It is an object of the present invention to provide a lower extremity orthotic device that allows for a powered knee brace to exert sufficient force upon a person coupled to the powered knee brace so as to provide assistance to that person in both standing and walking, with this knee brace being capable of producing the very large torques similar to those produced by the human body during walking, but without these torques resulting in undesirable person-device motion. It is a further object of this invention that this powered knee brace device function without producing undue discomfort or awkwardness to the patient coupled to the device.

It is an additional object of the present invention for the lower extremity orthotic device to allow for an orthotic hip device to provide assistance to a coupled patient of leg movement in swing and propulsion of the body in stance, but without restricting degrees of freedom about the hip or requiring overly complicated, and often bulky, or heavy mechanisms.

It is a further object of the present invention for the lower extremity orthotic device to be able to reliably lift the toe of a person, who is wearing an orthosis or exoskeleton, during swing, in order to prevent that person from stumbling or falling.

The primary aspect of this invention comprises of a powered knee orthosis device that is not solely coupled to the person at their shank and thigh, with this device including lightweight spars, or other rigid linkages, that run from the actuation module up the length of the thigh to the hip, and down the shank to the ankle, with this device having small, unpowered pivots which are aligned, respectively, with the hip and ankle pivots of the person, with these connecting pivots being coupled to the hip and ankle of the person, respectively. As the couplings at the hip and ankle of the person are very distant from the knee, the forces reacted there are much less than when the orthosis forces are reacted at the shank and thigh, and therefore the motion between the person and the device is much less, allowing for the actuators powering the motion of the knee to provide more force.

The second aspect of this invention provides for a system that powers the hips of an exoskeleton through an actuation device positioned directly between the thighs, thus avoiding the complexity of a pelvic link and the need to provide for thigh rotation and abduction. In accordance with this aspect, the thighs of the person are coupled through an actuator so that the design need not couple around the person's pelvis. A variation of this embodiment allows higher torques with different packaging, in which the connection between hips is made from a location on the hip in line with the person's hip pivots.

The third aspect of this invention provides a passive mechanism that assists with the hip movement of a person wearing an exoskeleton device. In the simplest embodiment, a spring element is provided that engages during terminal stance, when the hip is very flexed, and thereby provides assistance during early swing.

The fourth aspect of this invention has the hips of a person wearing an exoskeleton to be coupled in such a way so that power is transferred from one hip to another. In accordance with this aspect of the invention, the hips are coupled through a motion reversing mechanism, such as a differential, so that when the right hip is moving backwards, the left hip is forced to move forwards. To be effective, the motion reversing mechanism must be grounded, and when it is grounded to the torso the resulting device is referred to as a reciprocating gait orthosis (RGO). In this embodiment, the motion between the RGO and the torso is controlled. By placing an actuator, in most embodiments, an electric motor with a speed reducing transmission, between the differential and the torso, the device can be made to behave like an RGO by locking the motor, or made to behave as if there is no RGO by applying zero torque, or in an intermediate state by controlling the motor to a torque profile.

The fifth aspect of this invention comprises of a lightweight orthotic device that pivots at the ankle of the leg fitted with the device, with an electromechanical brake arranged at the pivot. A sensor on the opposite leg of that bearing this pivot device detects foot contact with the ground and locks the rotation of the ankle of the leg fitted with the pivot and electromechanical brake. This brake holds the pivot and the ankle of the device wearer in dorsiflexion during swing. When the foot on the leg opposite the leg bearing this pivot device re-contacts the ground at the end of swing, the brake releases for a natural stance cycle. By adjusting the timing, the swing angle of the ankle may be varied. A variant of this embodiment comprises of a device that holds the ankle of a person wearing the device in dorsiflexion during swing, but without requiring an orthosis. In this embodiment, a cable connects between a strapping on the foot and the shank of the patient, with a retraction spring on the shank keeping this cable under tension, and a brake device that restricts the motion of the cable when the opposite leg strikes the ground, holding the ankle position of the leg bearing the device until the leg bearing this device strikes the ground.

Overall, these aspects of the invention can be synergistically combined to provide for overall enhanced functionality of the orthotic device in aiding in the rehabilitation and muscular function in patients with impaired muscular function or control. In any case, additional objects, features and advantages of the invention will become more readily apparent from the detailed description presented below, particularly when taken in conjunction with the drawings wherein like reference numerals refer to corresponding parts in the several views.

DETAILED DESCRIPTION OF THE INVENTION

The present invention is used in conjunction with powered or unpowered orthotic devices that provide for walking motion or assistance in walking motion(s) for the orthotic wearer. A powered exoskeleton is one example of such a powered orthotic device. In a rehabilitation setting, powered exoskeletons are controlled by a physical therapist who uses one of a plurality of possible input means to command an exoskeleton control system. In turn, the exoskeleton control system actuates the position of the motorized braces, resulting in the application of force to, and often movement of, the body of the exoskeleton wearer.

Figure 1:
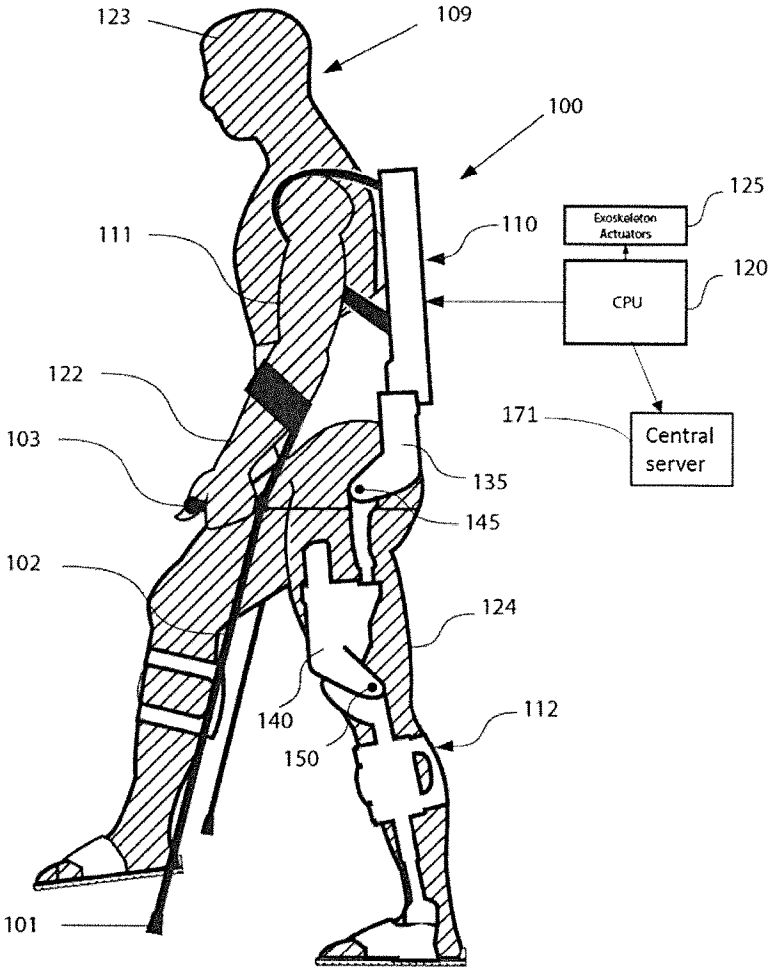
Figure 1 (Prior Art)
FIG. 1 is a schematic side view of a disabled individual coupled to a complex, powered, lower body ambulatory exoskeleton.

FIG. 1 shows, for reference, a full body exoskeleton which is generally known to the art; this is done primarily to provide reference to various exoskeleton components that will be referred to in the application. With reference to FIG. 1, exoskeleton 100 having a trunk portion 110 and lower leg supports 112 is used in combination with a crutch 102, including a lower, ground engaging tip 101 and a handle 103, by a person or wearer 109 to walk. The wearer 109 is shown to have an upper arm 111, a lower arm (forearm) 122, a head 123, and lower limbs 124. In a manner known in the art, trunk portion 110 is configurable to be coupled to an upper body (not separately labeled) of the wearer 109, the leg supports 112 are configurable to be coupled to the lower limbs 124 of the person 109 and actuators, generically indicated at 125 but actually interposed between portions of the leg supports 112 as well as between the leg supports 112 and trunk portion 110 in a manner widely known in the art, for shifting of the leg supports 112 relative to the trunk portion 110 to enable movement of the lower limbs 124 of the wearer 109. In some embodiments, trunk portion 110 may be quite small and comprise a pelvic link wrapping around the pelvis of wearer 109. In the example shown in FIG. 1, the exoskeleton actuators 125 are specifically shown as a hip actuator 135 which is used to move hip joint 145 in flexion and extension, and a knee actuator 140 which is used to move the knee joint 150 in flexion and extension. The exoskeleton actuators 125 are controlled by CPU 120, with CPU 120 being a constituent of an exoskeleton control system, in a plurality of ways known to one skilled in the art of exoskeleton control. Although not shown in FIG. 1, various sensors in communication with CPU 120 are provided so that CPU 120 may monitor the orientation of the device. Such sensors may include, without restriction, encoders, inertial sensors, pressure sensors, potentiometers, accelerometers, and gyroscopes, with these sensors being located in various positions on the exoskeleton structure, depending on the needs of a specific exoskeleton or control system. In addition, CPU 120 is in either continuous or intermittent communication with, and reports all collected data to, a central server 171. As the particular structure of various exoskeleton can take many forms, as is known in the art, the structure of this example exoskeleton will not be detailed further herein.

Figure 2A:
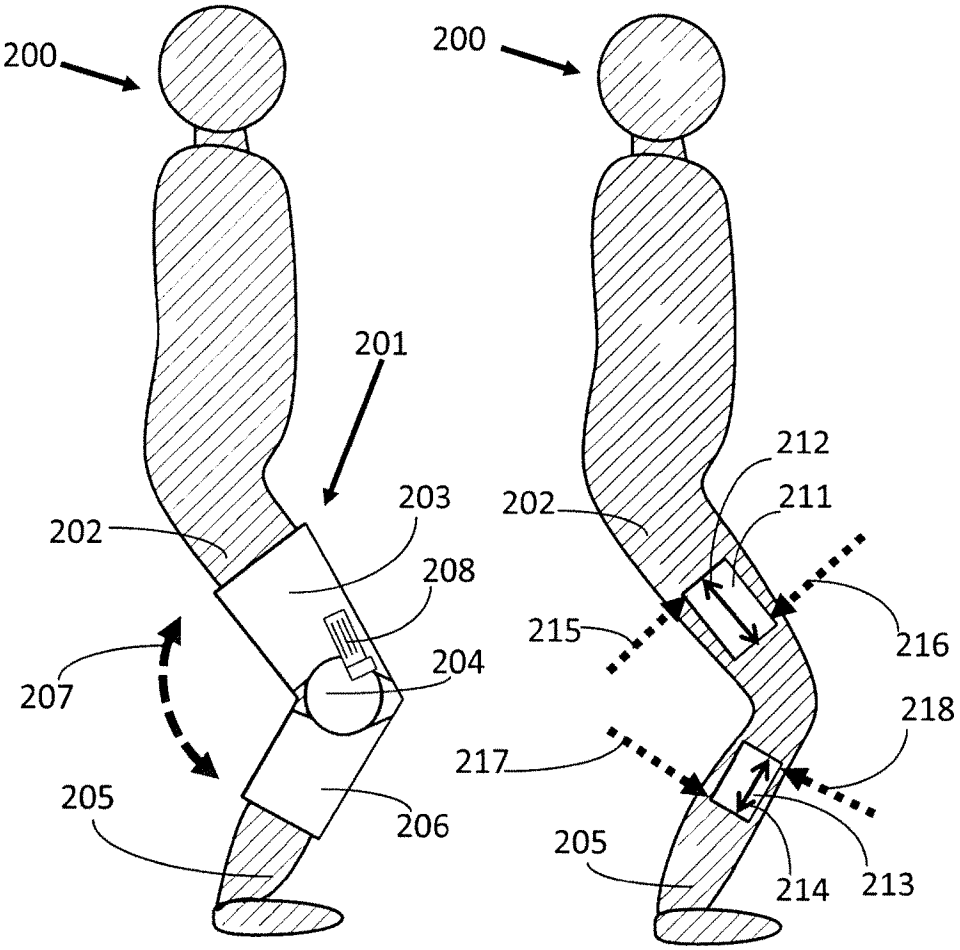
Figure 2a (Prior Art)
FIG. 2*a* is a side view drawing of a disabled individual coupled to a conventional powered knee orthosis, with this drawing showing the brace and resultant forces.

With reference to FIG. 2*a*, drawings representing a conventional powered knee orthosis device are shown. In the left panel of FIG. 2*a*, a drawing of a conventional knee orthosis is shown. Person 200 is wearing a conventional knee orthosis 201, with thigh structure 203 coupled to thigh 202 of person 200, with thigh structure 203 being rotatably connected to knee joint 204, with knee joint 204 being rotatably connected to shank structure 206, with shank structure 206 being coupled to shank 205 of person 200. Torque generator 208 is connected to both thigh structure 203 and knee joint 204, with torque generator 208 exerting torque about knee joint 204 resulting in flexion or extension in the path of arrow 207, with the rotation of knee joint 204 of orthosis 201 resulting in flexion or extension of the leg of person 200 by changing the relative angles of thigh 202 to shank 205 of person 200. In the right panel of FIG. 2*a*, a simple model of how the forces from a knee brace generating an assist torque are reacted onto the person. Here, the connection between person 200 and orthosis 201 is schematically represented as two patches, with thigh patch 211 being on thigh 202 of person 200, and shank patch 213 being on the shank 205 of person 200, with thigh patch 211 and shank patch 213 representing the strapping and/or cuffs that couple orthotic device 201 to person 200. Thigh patch 211 and shank patch 213 must both react to the torque applied by torque generator 208 about the knee 204, and as thigh patch length 212 and shank patch length 214 are relatively short, compared to the length of thigh 202 and shank 205, the forces required for powered orthosis device to 201 to move thigh 202 relative to shank 205 is rather high, with extension resulting from forces 215 and 216 on thigh patch 211 and forces 217 and 218 on shank patch 213, respectively. Although the forces are shown here as point loads on either edge of the strapping, it is understood that in well-designed strapping the force would be distributed, but simplifying to point loads does not change the nature of the problem with conventional powered knee orthoses; high knee torques result in undesirable relative motion between the person 200 and the orthosis 201, as a result of compression of either the tissues of person 200 or the padding/strapping of orthosis 201.

Figure 2B:
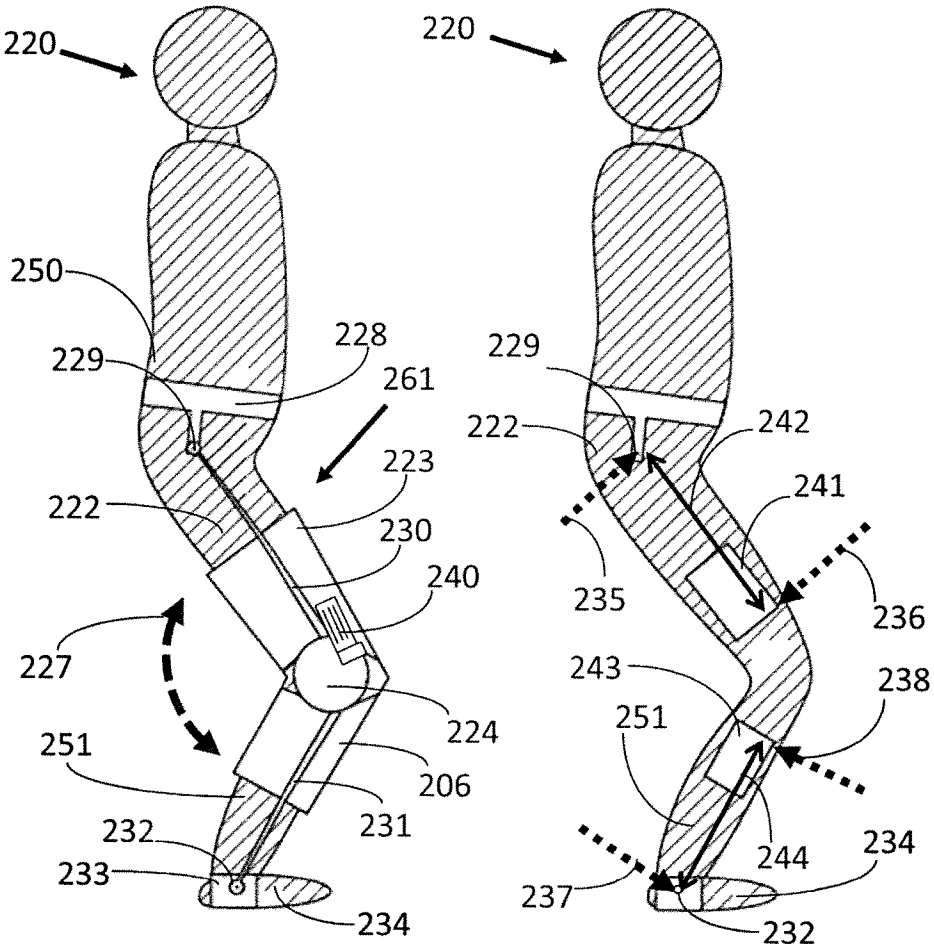
FIG. 2*b* is a side view drawing of a disabled individual coupled to the powered knee orthosis of this invention, with this drawing showing the brace and resultant forces.

With reference to FIG. 2*b*, drawings representing the powered knee orthosis device of the primary embodiment of this invention are shown. The powered knee orthosis of the first embodiment is, using any appropriate actuation technique, coupled to the person in several places, in addition to their shank and thigh. Lightweight spars are run from the actuation module up the length of the thigh to the hip and down the shank to the ankle, as shown in FIG. 2*b*. At the hip and the ankle, small, unpowered pivots are provided, and these pivots are aligned, respectively, with the hip and ankle pivots of the person. In the left panel of FIG. 2*b*, a drawing of the powered knee orthosis device of the primary embodiment is shown. Person 220 is wearing powered orthosis 261, with orthosis 261 being coupled to the waist of person 220 by waist belt 228, with waist belt 228 being rotatably connected to thigh link 230 by waist link 229, with thigh link 230 being connected to thigh structure 223, with thigh structure 223 being coupled to thigh 222 of person 220, with thigh link 230 being rotatably connected to knee joint 224, with knee joint 224 being rotatably connected to shank link 231, with shank link 231 being coupled to shank 251 of person 220, with shank link 231 being rotatably connected to foot link 232, with foot link 232 being connected to foot structure 233, with foot 234 of person 220 being coupled to foot structure 233. Torque generator 240 is connected to both thigh link 230 and knee joint 224, with torque generator 240 exerting torque about knee joint 224 resulting in flexion or extension in the path of arrow 227, with the rotation of knee joint 224 of orthosis 261 resulting in flexion or extension of the leg of person 220 by changing the relative angles of thigh 222 to shank 251 of person 220.

In the right panel of FIG. 2*b*, a simple model of how the forces from a knee brace generating an assist torque are reacted onto the person. Here, the connection between person 220 and orthosis 261 is schematically represented as two patches, with thigh patch 241 being on thigh 222 of person 220 and shank patch 243 being on the shank 251 of person 220, with thigh patch 241 and shank patch 243 representing the strapping and/or cuffs that couple orthotic device 261 to person 220. Since knee joint 224 is connected to shank link 231 and thigh link 230, which are connected to foot link 232 and waist link 229, respectively, the torque from torque generator 240 is exerted over longer distances, thigh length 242 and shank length 244, with extension resulting from force 235 on waist link 229, force 236 on thigh patch 241, force 238 on thigh patch 238, and force 237 on foot link 232.

In this first embodiment of this invention, the inclusion of the pivots at the hip and foot is a critical addition. In practice, the original strapping of lengths on the thigh and shank cannot be made longer because the person will find it uncomfortable to place strapping on the upper thigh or the lower shank; instead the pivots allow for the additional strapping to be located much farther from the knee, minimizing the forces. Furthermore, the waist belt acts near the center of mass of the person, and the foot strap acts near the reaction to the ground: the result is that the knee torque acts nearly directly between the center of mass and ground. As the couplings at the hip and ankle of the person are very distant from the knee, the forces reacted there are much less than when the orthosis forces are reacted at the shank and thigh, and therefore the motion between the person and the device is much less, allowing for the actuators powering the motion of the knee to provide more force. Yet, while such a design dramatically improves the function of the device, the complexity and cost of the additional structural component is not significant when compared to the actuation of the orthosis itself. In some embodiments, the orthosis is fitted with sensors, such as inertial sensors or pressure sensors, in various locations upon the orthosis that report information to an orthosis control system which controls the action of the torque generator on the orthosis, with these sensors reporting information on the orthosis state to the orthosis control system. In some embodiments, the torque generator is an electric motor, actuator, or other device known in the art.

In an example of the primary embodiment of this invention, consider a disabled patient in a rehabilitation setting who has limited strength in one leg. If this patient were to use the device of the invention, the orthosis would be able to provide additional knee torque to the patient, relative to the torque available by conventional powered orthoses, aiding this patient in knee motions related to walking and improving rehabilitative benefit.

Figure 3A:
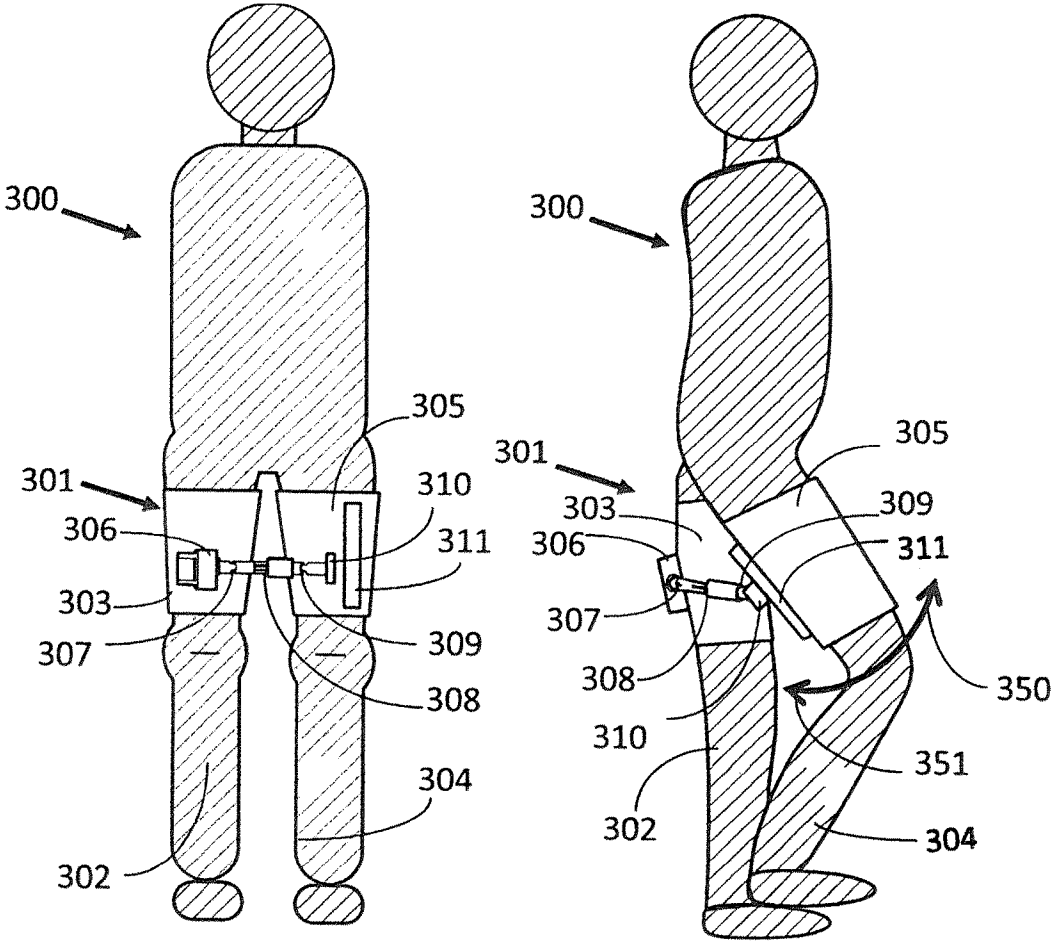
FIG. 3*a* is a drawing showing a rear view and a side view of a disabled individual wearing an actuated thigh coupling orthosis device of this invention.
Figure 3B:
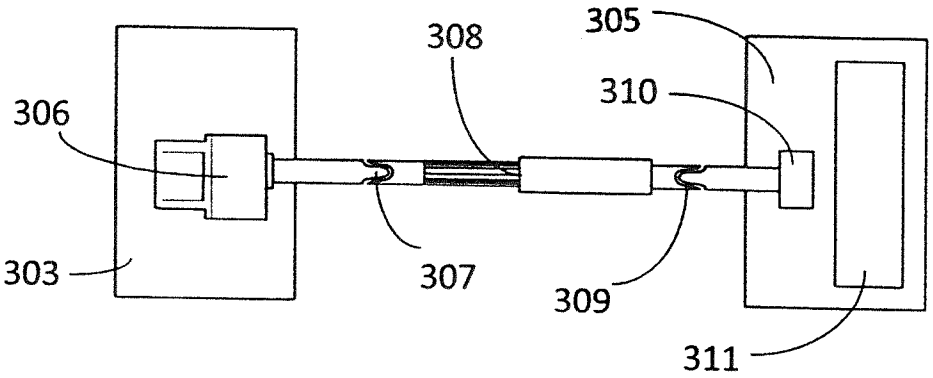
FIG. 3*b* is a drawing showing a closer rear view of the thigh coupling assistive device of FIG. 3*a*.

With reference to FIGS. 3*a* and 3*b*, drawings representing one form of the powered thigh coupling orthosis device of a modified embodiment of this invention are shown. The human hip is a three degree of freedom joint, allowing motion in all three rotational axes. While the high powers for walking are required only in the sagittal plane, unpowered degrees of freedom must often be provided in the other axes in order to allow for normal walking. Some devices approximate these degrees of freedom with complex mechanisms, and others simply lock out these degrees of freedom, constraining the person. In this embodiment, the thighs of the person are coupled through an actuator so that the design need not couple around the person's pelvis. Person 300 is wearing thigh coupling orthosis 301, with left thigh segment or structure 303 being coupled to the thigh of left leg 302 of person 300, and with right thigh segment or structure 305 being coupled to the right thigh of person 300. Left thigh structure 303 contains electric motor 306, while right thigh structure 305 contains batteries and electronics 311. Motor 306 connects to a universal joint 307, with universal joint 307 being rotatably connected to a sliding spline 308, with sliding spline 308 being rotatably connected to a universal joint 309, with universal joint 309 being connected to mount 310 on right thigh structure 305 such that an actuator link is established between right and left thigh structures 303 and 305. Torque generated in motor 306 is reacted directly in thigh segment 305; as thigh segments 303 and 305 are coupled to the thighs of person 300, the thighs of person 300 are driven equally and oppositely with the torque generated by motor 306, resulting in either flexion 350 or extension 351 of leg 304 of person 300. In other words, a single actuator is used to drive the right and left thigh structures 303 and 305 in opposite directions, e.g., one in an anterior direction and one in a posterior direction. Of course, in most embodiments, motor 306 will also comprise a transmission to generate a high torque, low speed motion appropriate to walking. Thigh segments 303 and 305 are coupled only to the thighs of person 300, and as a result the device cannot produce large torques (because the forces applied to react the torque to the thighs will be unacceptably high; consider the first embodiment). Still, at the human hip joint, a modest torque of only 10 to 20 Newton-meters can produce a significant effect and result in a better gait for a person needing assistance and this torque can be applied at the thighs just as well as the hips. This design is further advantageous over existing devices because only one motor or actuator is required, simplifying the design of the device. In some embodiments, the electronics and batteries may be on the same side as the motor so that all the electrical elements are collocated, although this has the disadvantage that the weight is not evenly distributed. In some embodiments, the orthosis is fitted with additional sensors, such as inertial sensors, e.g., accelerometers and gyroscopes, in various locations upon the orthosis that report information to an orthosis control system which controls the action of the torque generator on the orthosis, with these sensors reporting information on the orthosis state to the orthosis control system. In some embodiments, inertial sensors, and even the control system, may be part of electronics 311 so that the complexity of the device is minimized, or may be included in both thigh structures 303 and 305 to capture motion information from both legs. In some embodiments, the torque generator is an electric motor, actuator, or other device known in the art.

Figure 4:
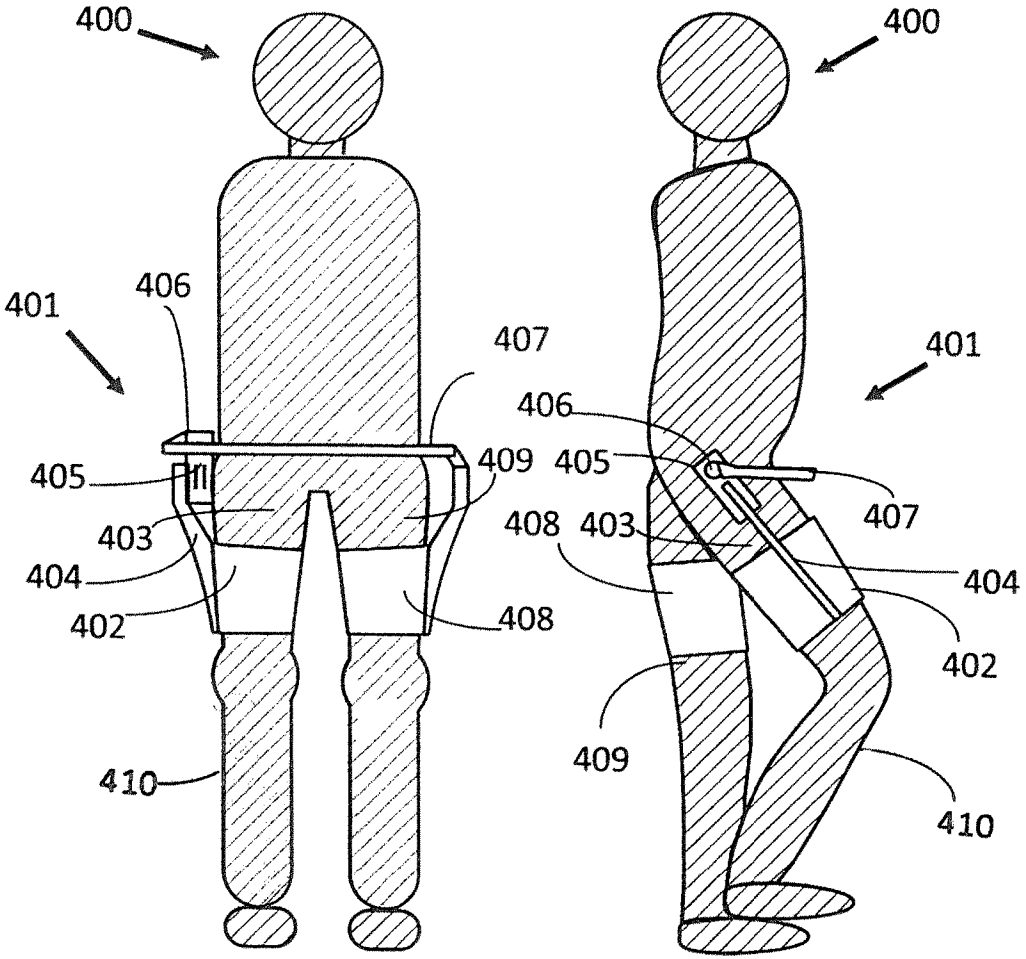
FIG. 4 is a drawing showing a front view and a side view of a disabled individual wearing a variant configuration of the actuated thigh coupling orthosis device of this invention.

With reference to FIG. 4, the drawings represent a variation of the overall powered thigh coupling orthosis device of the invention. This variation allows higher torques with different packaging. In this embodiment, the connection between the hips is made from a location on the hip in line with the person's hip pivots. As a result, the universal joints and spline are not needed. With reference to FIG. 4, person 400 with left thigh 409 and right thigh 403 is wearing device 401. The device is comprised of right link 404, actuator 405, and left link 407. Right link 404 is coupled to right thigh 403 with right thigh structure 402, and left link 407 is coupled to left thigh 409 with left thigh structure 408. Right and left links 404 and 407 are coupled through actuator 405, rotating concentrically about hip pivot 406. Hip pivot 406 is in line roughly with the centers of rotation of the hips of person 400. Actuator 405 torques left link 407 with respect to right link 404. Actuator 405 may be generally held onto the torso of person 400 with additional strapping that is not shown, but this strapping does not apply torque to the torso with respect to either thigh link. In operation, a controller causes actuator 405 to provide torque while person 400 is walking. The torque provided by actuator 400 acts directly between the legs of the person, resulting in either flexion 450 or extension 451 of leg 410 of person 400, assisting in their walking. It is understood that the device could operate equally well with the opposite configuration, i.e., actuator 406 could instead be attached to the left hip with appropriately redesigned interconnecting links. Finally, the connection between the proximal end of left link 407 and actuator 405 can incorporate passive (unpowered) degrees of freedom in axes other than that of hip pivot 406, allowing for normal motion of the thighs. Furthermore, left link 407 may be behind the person rather than in front, but in either case extends across the person to interconnect the right and left thigh structures 402 and 408. In some embodiments, the chirality of the invention may be revered, with the actuator on the left side and the right and left links reversed.

Figure 5A:
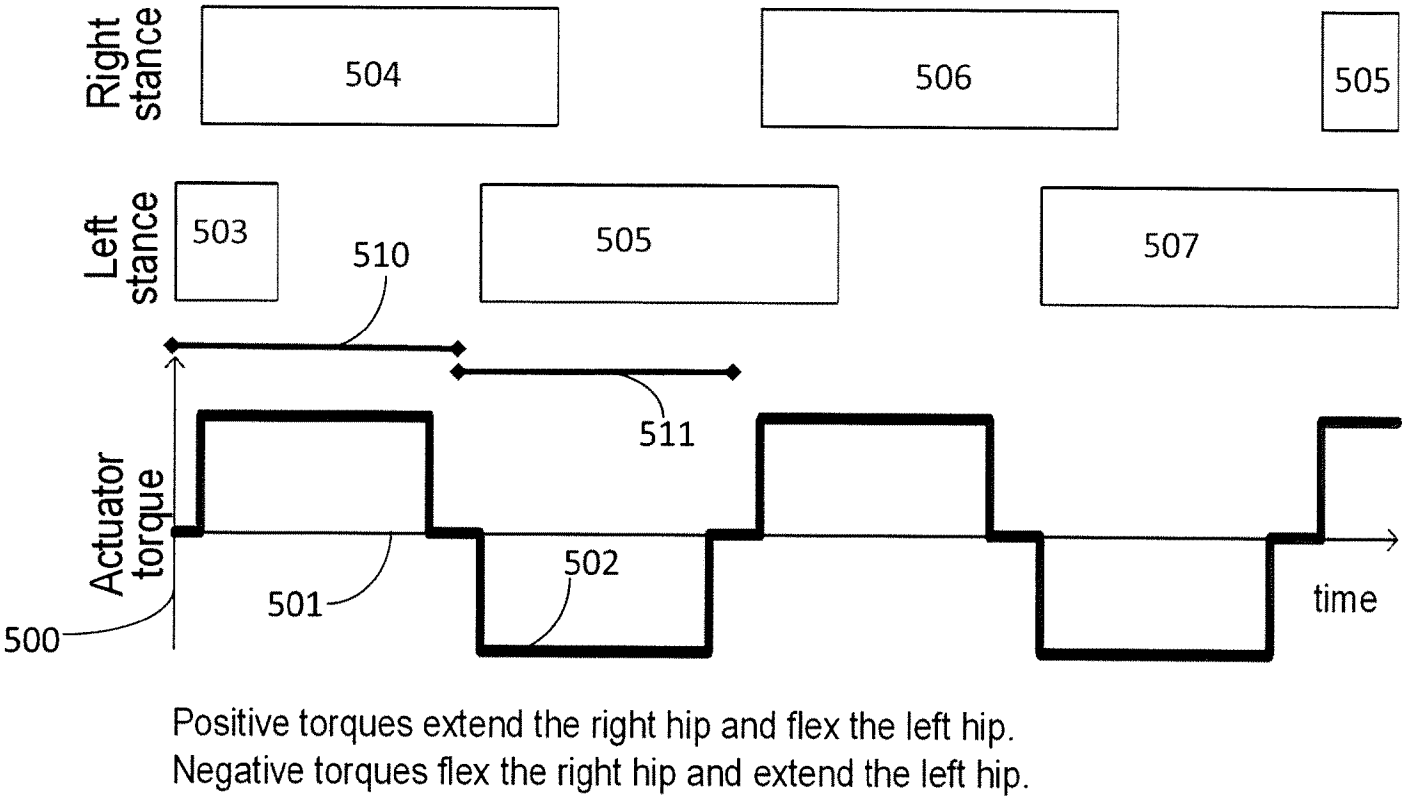
FIG. 5*a* is a plot of hip actuator torque as a function of stance phases exemplifying data for a person coupled to the thigh coupling devices of this invention.
Figure 5B:
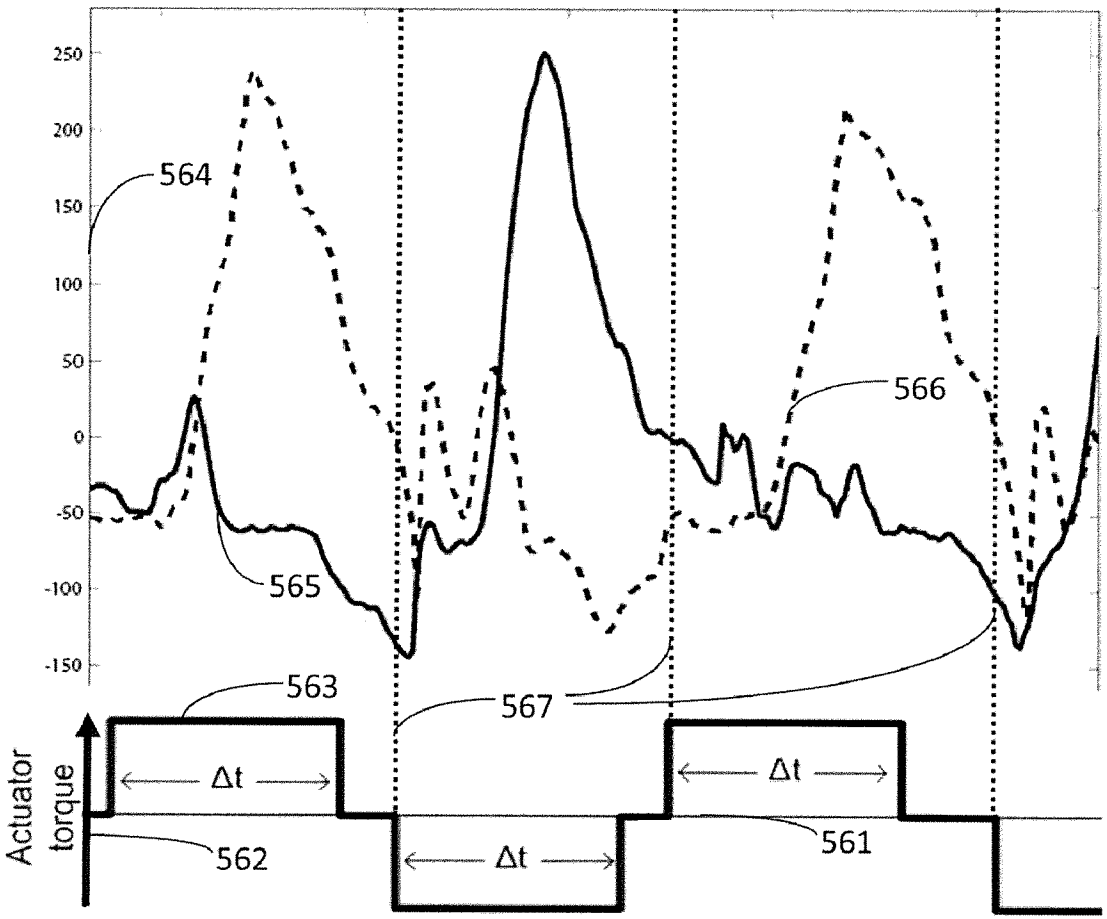
FIG. 5*b* is a plot of hip actuator torque as a function of stance phases for the coupled hip devices of this invention.

The devices of this embodiment allows torque to be provided directly from one thigh to another. In either of these embodiments, a typical torque profile with respect to stance phases is shown in FIG. 5*a*. This profile provides a propulsive torque, shown on the Y axis 500, versus time, shown on the X axis 501, with trace 502 representing actuator torque during stance, and assists in throwing the leg forward during swing. Periods of right leg stance are shown as 504, 506, and 505, while periods of left leg stance are shown as 503, 505, and 507, with a left leg swinging step shown as 510, and a right leg swinging step shown as 511. In some embodiments, there may be a series elastic element between the legs so that the elastic element stores energy during double stance and releases that energy as the swing leg leaves the ground. FIG. 5*b* shows an additional embodiment of this controller that does not need foot sensors, and can be implemented simply using the thigh angular rates based on a MEMS gyroscope that may be included in the orthosis. Regarding FIG. 5*b*, actuator torque is plotted on Y-axis 562, while time is plotted on X-axis 561, with actuator torque trace 563 being plotted such that positive actuator torques extend the right hip and flex the left hip, while negative actuator torques flex the right hip and extend the left hip. Y axis 564 shows hip angular rate in degrees per second, with X-axis 562 in time, where the angular rate of right leg 410 is shown as solid trace 565, while the angular rate of left leg 409 is shown as dashed trace 566, and interstep cycle spacing is marked by dotted lines 567. As shown, the stance phase is assumed to start when the thigh angular velocity is zero after it has been large and positive. Of course, the stance phase could start slightly earlier or later by looking for, respectively, a thigh rate that is slightly positive or negative rather than zero.

In an example of the FIGS. 3*a* and 3*b* embodiment of this invention, consider a disabled patient in a rehabilitation setting who has limited strength in both legs, and specifically limited strength in the hips. If this patient were to use the device of this embodiment, the orthosis would be able to provide additional hip torque to the patient, aiding this patient in knee motions related to walking and improving rehabilitative benefit.

Figure 6A:
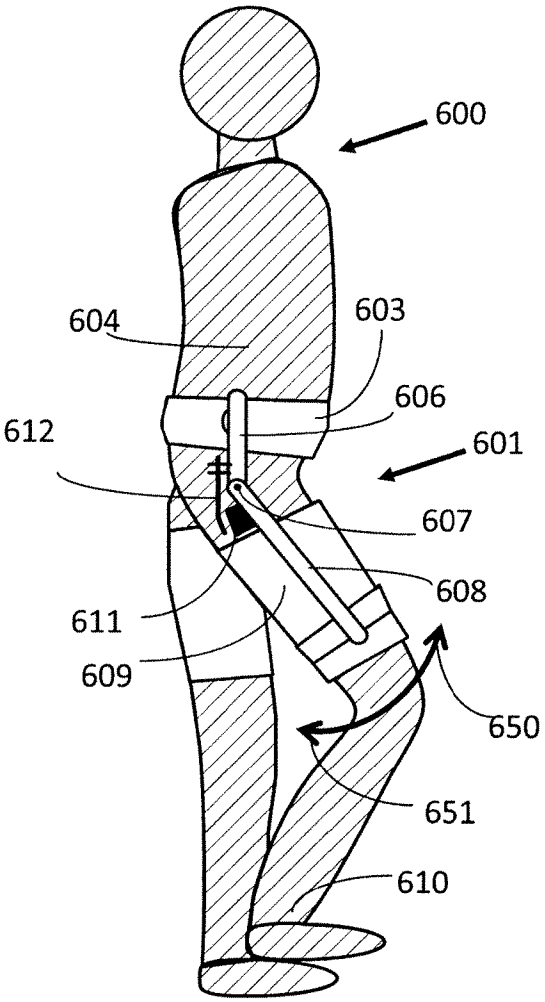
FIG. 6*a* is a drawing showing a side view of a disabled individual wearing a passive hip assistive device of this invention.

With reference to FIG. 6*a*, a drawing representing the passive hip assistive device of a third embodiment is shown. Person 600 is wearing orthosis 601, with waist belt or link 603 being coupled to waist 604 of person 600, with hip support 606 being connected to waist belt 603, with hip support 606 being rotatably connected to hip link 607 establishing a hip joint, with hip link 607 being connected to thigh support or link 608, with thigh support 608 being connected to thigh structure 609, with thigh structure 609 being coupled to leg 610 of person 600. Hip support 606 is connected to an actuator, specifically in the form of a spring resilient element, such as a leaf spring 612. Thigh support 608 is connected to spring stop 611. Hip link 607 is aligned with the hip of person 600. At small hip flexion angles, i.e., when the thigh support 608 is approximately posterior of vertical, leaf spring 612 engages spring stop 611 and generates hip torque; at large angles leaf spring 612 disengages from stop 611 and produces no hip torque. With this arrangement, the spring resilient element advantageously generates torque in the hip flexion direction during late stance and early swing. The actual abutment location can be adjusted, such as by repositioning or changing the slope of stop 611. In some embodiments, the hip of the orthosis has additional features enabling abduction and rotation, such as those disclosed in FIG. 12 of U.S. Pat. No. 7,947,004 which is incorporated herein by reference. In some embodiments, the orthosis is fitted with sensors, such as inertial sensors or pressure sensors, in various locations upon the orthosis that report information to an orthosis control system which controls the action of the torque generator on the orthosis, with these sensors reporting information on the orthosis state to the orthosis control system. In some embodiments, the torque generator is an electric motor, actuator, or other device known in the art.

Figure 6B:
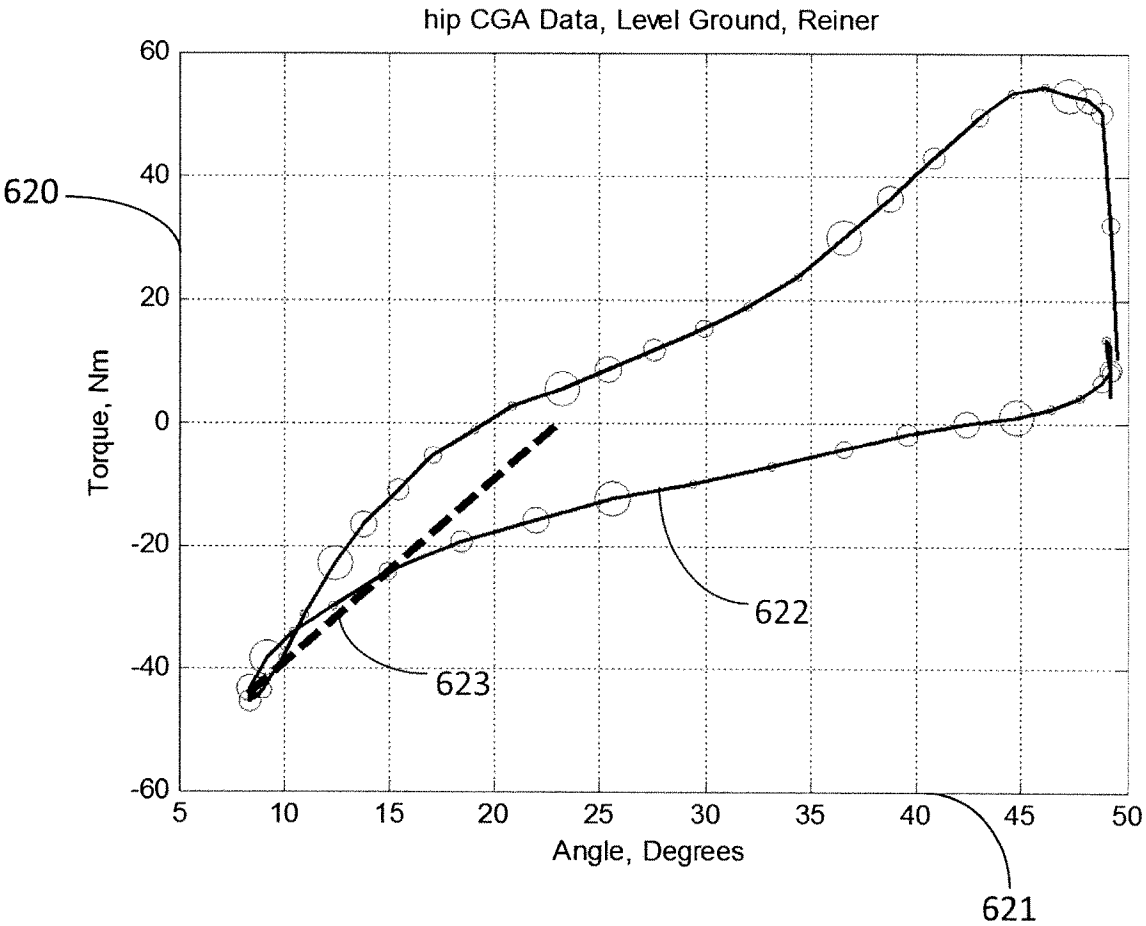
FIG. 6*b* is a plot showing hip gait data, shown as the solid trace with open circles, with overlaid spring data, shown as a dashed line, representing the use of the passive hip device of this invention that assists in late stance and early swing.

With reference to FIG. 6*b*, a plot showing hip gait data representing the FIG. 6*a* arrangement is shown. Human gait data that has been plotted parametrically for one step as hip angle versus hip torque, with torque plotted on the X-axis 620 and angle plotted on the Y-axis 621. Hip gait data is shown as a solid trace with open circles 622, while overlaid spring data appears as a dashed line 623, representing the FIG. 6*a* arrangement of this invention that assists in late stance and early swing, increasing (forward) hip angles 650 and decreasing (rearward) hip angles 651 are shown in FIG. 6*a*. Heel strike occurs at the far right of the plot, and time proceeds counter clockwise; the large torques at the top of the loop are stance, the far left of the plot is roughly toe-off, and the small negative torques are swing. The hip torque/angle relationship can be approximated by a line in this region, and that line can be realized with a spring that disengages above a hip angle.

In an example of the FIG. 6*a* arrangement of this invention, consider a disabled patient in a rehabilitation setting who has limited strength in their legs who is engaged in physical therapy using an unpowered orthosis. If this patient were to use the device of FIG. 6*a*, the patient will be provided assistance in the hip motions associated with walking, without requiring an orthosis powered at the hip or the related control systems.

Figure 7:
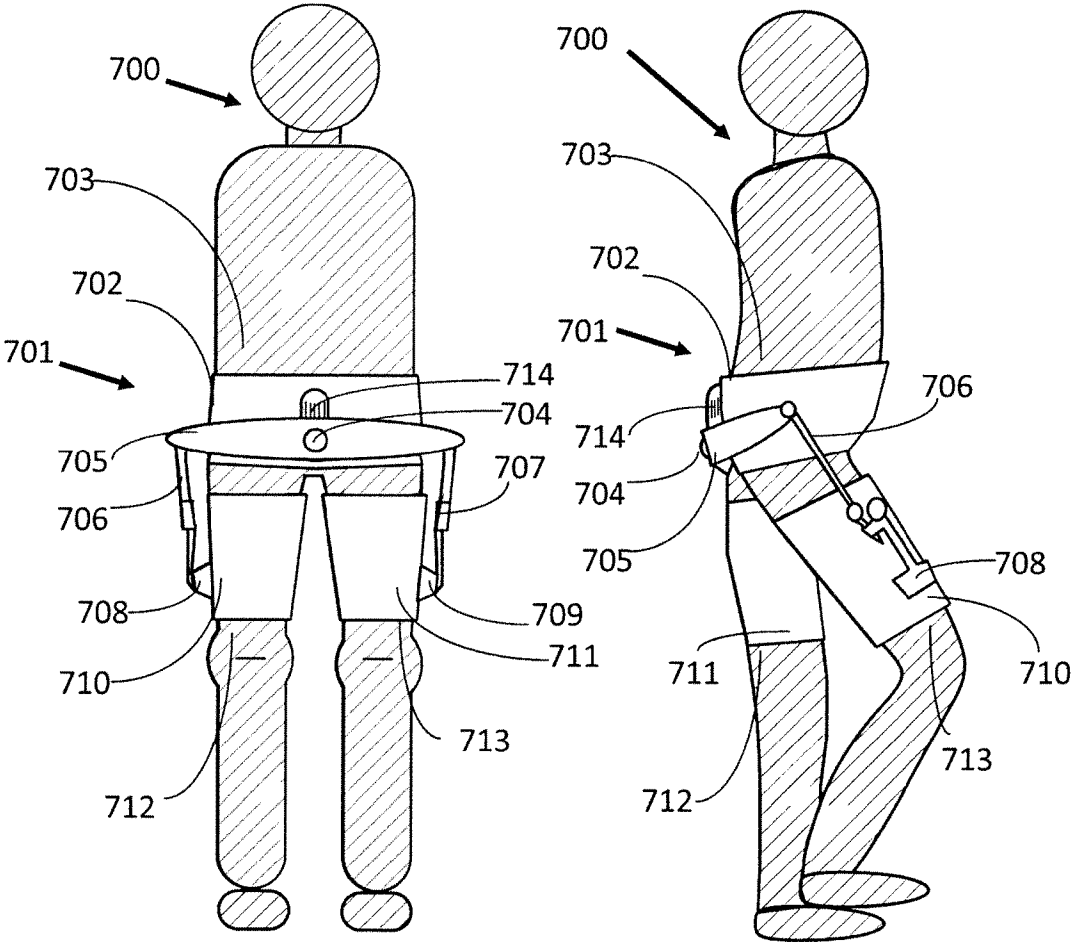
FIG. 7 is a drawing showing a side view of a disabled individual wearing an actuated reciprocating gait orthosis device constructed in accordance with the invention.

With reference to FIG. 7, a drawing representing the powered reciprocating gait orthosis device of a modified form. In this embodiment, the device couple the hips of the person so that power is transferred from one hip to another. This embodiment has particular advantage for a patient exhibiting a hemiplegic strength deficit, that is, a strength deficit on only one side of their body. In this embodiment, the hips are coupled through a motion reversing mechanism such as a differential so that when the right hip is moving backwards, the left hip is forced to move forwards. To be effective, such as an aid in late stance and early swing, the motion reversing mechanism must be grounded, and when it is grounded to the torso, the resulting device can be referred to as a reciprocating gait orthosis (RGO). In this embodiment, the device is furthered by controlling the motion between the RGO and the torso. By placing an actuator (in most embodiments, an electric motor with a speed reducing transmission) between the differential and the torso, the device can be made to behave like an RGO by locking the motor, or made to behaving as if there is no RGO by applying zero torque, or in an intermediate state by controlling the motor to a torque profile. Regarding FIG. 7, person 700 is wearing RGO 701, with waist brace or link 702 being coupled to waist 703 of person 700, with rocker arm 705 being connected by pivot 704 to waist brace 702, with actuator 714 applying force between rocker arm 705 and waist brace 702 resulting in rotation about pivot 704. Rocker arm 705 is additionally rotatably connected to right thigh link 706 and left thigh link 707, with right thigh link 706 being rotatably connected to right thigh mount 708, with right thigh mount 708 being rotatably connected to a right thigh structure or segment 710, with right thigh structure 710 being coupled to right thigh 712 of person 700, and left thigh link 707 being connected to left thigh mount 709, with left thigh mount 709 being rotatably coupled to a left thigh structure or segment 711, with left thigh structure 711 being coupled to left thigh 713 of person 700. Through RGO device 701, forces from the movements of left thigh 713 of person 700 are transmitted to right thigh 712 of person 700, with an actuator 714 selectively affecting the linked movements of and applying forces to left thigh 713 and right thigh 712 of person 700. Actuator 714 can take various forms, including a powered actuator, a brake, or a resilient biasing member. In some embodiments, the orthosis is fitted with addition sensors, such as inertial sensors or pressure sensors, in various locations upon the orthosis that report information to an orthosis control system which controls the action of the torque generator on the orthosis, with these sensors reporting information on the orthosis state to the orthosis control system. In some embodiments, the actuator is placed in a different location, as actuation at any point on the orthosis can make use of the rocker arm to transfer force across the orthosis. In some embodiments, the RGO is not a rocker arm RGO, but is an RGO that uses cables or other means to transfer force across the orthosis. In some embodiments, it may be advantageous to instead place the actuator across only one of the left and right hip joints which allows power to be provided to both hip joints through the RGO.

In an example of this arrangement of this invention, consider a disabled patient in a rehabilitation setting. This RGO device has numerous advantages for use in a person with some function in one or both legs. First, when encountering an obstacle where the stiff gait imposed by an RGO will not work, freeing the motor (e.g., controlling it to zero current) effectively removes the RGO. As long as the patient has enough strength for a single step, they may disengage and reengage the RGO. Similarly, it allows a patient to sit in a chair while wearing the device. Second, the controller may allow the angle of the torso relative to the legs to change during the walking cycle, thereby making use of the RGO more comfortable and allow walking over varied terrain. Finally, in some embodiments, it may be desirable to vary the angle between the torso and the RGO body during a single gait cycle (i.e., continuously while walking) so that power is transferred to the person's gait cycle.

Figure 8A:
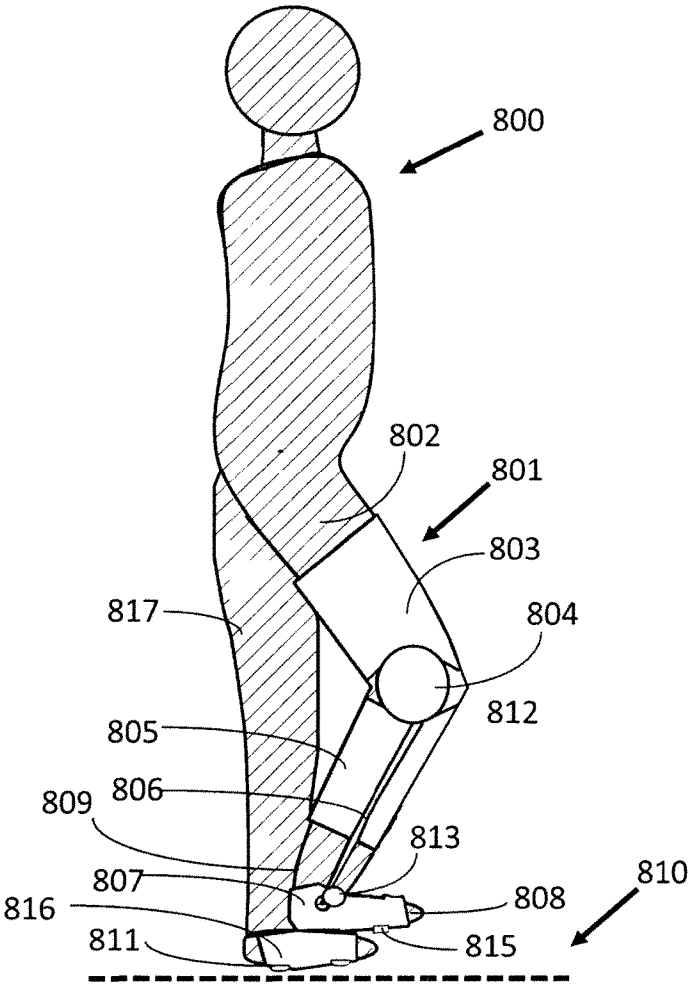
FIG. 8*a* is a drawing showing a side view of a disabled individual coupled to an orthotic device including a foot and ankle assistive device of this invention.
Figure 8B:
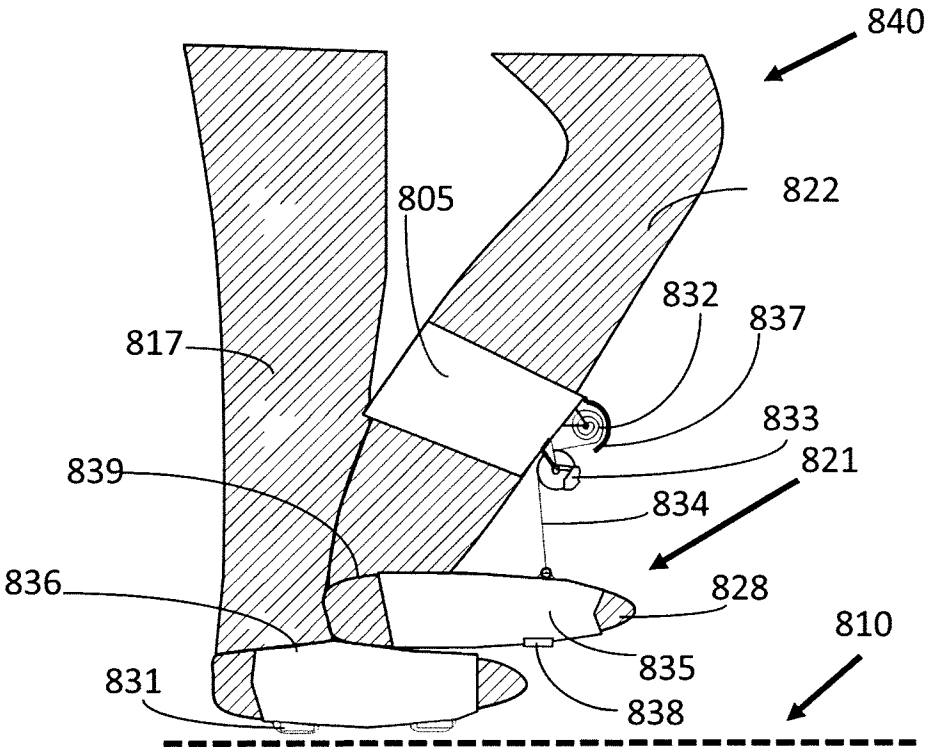
FIG. 8*b* is a drawing showing a side view of a disabled individual coupled to a variant of the foot and ankle assistive device of FIG. 8*a*.

With reference to FIGS. 8*a* and 8*b*, an ankle and foot assistive orthotic device of the overall invention is shown. For some persons suffering from lower extremity weakness (often, but not always, post stroke), preventing foot drop is important, because otherwise the person may drag their toe on the ground, stumble, and fall. The goal for the device is to reliably lift the toe for the person during swing. The device may provide assistance with foot drop in two exemplary embodiments. FIG. 8*a* illustrates one embodiment in which lightweight orthotic pivoting at the ankle is provided, with an electromechanical brake arranged at the pivot, with person 800 wearing orthotic 801, with orthotic 801 being coupled to right leg 802 of person 800 by thigh structure 803 and shank structure 805, with foot 808 of person 800 being coupled to foot or heel structure 807 and stirrup 815, with thigh structure 803 being rotatably connected to knee 804, with knee 804 being rotatably connected to shank structure 805 and shank link 806, with shank link 806 being rotatably connected to heel structure 807. Brake 813 selectable locks the angle of shank link 806 relative to foot structure 807, resulting in a lock of the angle of shank 809 of person 800 relative to foot 808 of person 800. Brake 813 engages in locking when ground sensors 811 attached to foot structure 816 attached to the left leg 817 of person 800 detect contact between ground sensors 811 and surface 810. In this way, the ankle of the right leg of person 800 is fixed in dorsiflexion during swing. When the foot 808 and foot structure 807 contact surface 810 at the end of swing, ground sensor 815 detects contact between foot structure 807 and surface 810, signaling brake 813 to release and allowing the for a natural stance cycle for the right leg of person 800. By adjusting the timing, the swing angle of the ankle may be varied. In some embodiments, other types of sensors are used to determine when the brake should be engaged. In some embodiments, the brake is some other type of selectably engaged locking mechanism, such as a locking pin or electric motor, or other device known in the art.

In an alternative embodiment shown in FIG. 8*b*, a device is shown that holds the ankle of a person wearing the device in dorsoflexion during swing, but without requiring a shank link. Regarding FIG. 8*b*, person 840 is wearing device 821, with device 821 being coupled to right leg 822 of person 840 by ankle cuff 805 and foot 828 of person 840 by foot structure 835. Foot structure 835 is connected to cable 834, with cable 834 interacting with braking device 833, with cable 834 being held is tension and connected to a retraction spring 832 or other retraction resilient element, with retraction spring 832 being connected to ankle cuff 805. Housing structure 837 is connected to ankle cuff 805 and covers retraction spring 832, and in some embodiments braking device 833. The tension of retraction spring 832 is only strong enough to keep cable 834 in tension, but not strong enough to be noticeable by person 840. Left leg 817 of person 840 is fitted with foot structure 836, with ground sensor 831 being connected to foot structure 836. Similarly to the previously discussed device of FIG. 8*a*, when ground sensor 831 detects contact with surface 810, braking device 833 engages and locks cable 834 in place, fixing the angle of ankle 839. In this way, the ankle of the right leg of person 800 is fixed in dorsiflexion during swing. In some embodiments, when ground sensor 835 detects contact with surface 810, braking device 833 releases cable 834 and allows ankle 839 to pivot. In another embodiment, braking device 833 is sized so that when leg 822 strikes the ground, braking device 833 does not produce enough force to hold cable 834, allowing ankle 839 to pivot. This is possible because the force necessary at brake 833 to hold the foot 828 up during swing is much less than the force generated at braking device 833 by heel strike of foot 828 (and much more than the force at brake 833 produced by retraction spring 832). In some embodiments, the cable is a chain, such as a bicycle chain, which might be engaged with various gearing mechanisms, including those attached to a braking device.

In an example of this arrangement, consider a patient in a rehabilitation setting who has recently suffered a stroke, and has problems with foot drag during gait on the stroke affected side. If this patient were to use this device, the device would be able to lift the affected foot of the patient during swing, preventing foot drag and possibly preventing injuries cause by a trip or fall related to foot drag.

In general, these various methods for assisting with hip motion and foot drop can be combined with various methods of stance control that are well understood in the art. Furthermore, the hip and foot methods may be combined with a powered knee brace using the device of the first embodiment design. For example, thigh element 608 of the hip spring mechanism in FIG. 6*a* could be the thigh link 230 from the powered knee brace of FIG. 2*b*. In another embodiment, the thigh assistance device of FIG. 4 could be combined with the toe drop mechanism of FIG. 8*b*. In some embodiments, the knee brace may not be powered, but may be one of a number of well understood devices that provide knee support during stance. Therefore, it should be realized that two or more of the knee, thigh, hip and ankle/foot assistive orthotic devices described above can be used in combination, actually producing synergistic results in aiding in the rehabilitation and restoration of muscular function in patients with impaired muscular function or control.

We claim:

1. A lower extremity orthosis, configurable to be coupled across at least one joint of a person for gait assistance comprising:

a thigh orthosis including left and right, interconnected thigh structures configured to be coupled to the person and a single actuator configured to drive the left and right thigh structures equally and in opposite directions, wherein the opposite directions include an anterior direction and a posterior direction; and one or more of:

a) a knee orthosis including a waist link configured to be coupled to the person, a thigh link, a shank link configured to be coupled to the person, a knee joint and a torque generator, with said thigh link being rotatably connected both to said waist link at a hip joint and at the knee joint, said shank link being rotatably connected at the knee joint, and the torque generator being configured to exert torque about the knee joint to result in flexion or extension of a leg of the person wearing the lower extremity orthosis, with forces generated by the torque generator being reacted at said waist link and the shank link;

b) a hip orthosis including the thigh link, the waist link, and an actuator, with said thigh link and said waist link being configured to be coupled to the person, said thigh link being rotatably connected to said waist link at the hip joint, and said actuator of the hip orthosis being positioned to provide a force on the thigh link during late stance and early swing; and c) an ankle orthosis including a shank structure configured to couple to a shank of the person, a foot structure configured to couple to a foot of the person, and a brake device, said shank structure and said foot structure being interconnected, whereby the ankle orthosis is configured to help prevent foot drop of the foot during a swing phase of a gait cycle using the brake device.

2. The lower extremity orthosis of claim 1, wherein the lower extremity orthosis includes the knee orthosis which further includes a foot link rotatably connected to the shank link at an ankle joint, and where the forces generated by the torque generator are also reacted at the foot link.

3. The lower extremity orthosis of claim 1, wherein the lower extremity orthosis includes the knee orthosis and the torque generator extends directly between the thigh link and the knee joint.

4. The lower extremity orthosis of claim 1, wherein the lower extremity orthosis includes the knee orthosis which comprises the foot structure configured to be coupled to the foot of the person, wherein a foot link is coupled to the foot structure at an ankle joint and wherein the lower extremity orthosis establishes the hip joint, the knee joint and the ankle joint.

5. The lower extremity orthosis of claim 1, wherein the single actuator is constituted by a motor which drives a spline connection interconnecting the left and right thigh structures.

6. The lower extremity orthosis of claim 5, further comprising at least one universal joint provided between the interconnected thigh structures.

7. The lower extremity orthosis of claim 1, wherein the thigh orthosis comprises at least one inertial sensor providing thigh position information to a controller for regulating the single actuator.

8. The lower extremity orthosis of claim 1, wherein the thigh orthosis comprises a link extending across a body of the person to interconnect the left and right thigh structures.

9. The lower extremity orthosis of claim 8, wherein the single actuator rotates concentric with a hip pivot.

10. The lower extremity orthosis of claim 1, wherein the lower extremity orthosis includes the hip orthosis and said actuator of the hip orthosis comprises a spring resilient element acting between the waist link and the thigh link.

11. The lower extremity orthosis of claim 10, wherein the spring resilient element constitutes a leaf spring.

12. The lower extremity orthosis of claim 10, wherein the actuator of the hip orthosis further comprises a stop which is abutted by the spring resilient element at small hip flexion angles and disengages from the stop at larger angles.

13. The lower extremity orthosis of claim 1, wherein the lower extremity orthosis includes the ankle orthosis, and the brake device limits pivoting movement of the foot structure relative to the shank structure.

14. The lower extremity orthosis of claim 13, further comprising a ground sensor, wherein the brake device prevents relative pivoting movement between the foot and shank structures upon detecting when the foot structure engages a supporting ground surface.

15. The lower extremity orthosis of claim 13, wherein the brake device constitutes an electromagnetic brake.

16. The lower extremity orthosis of claim 13, further comprising a cable extending between the shank structure and the foot structure, said cable connected to a retraction resilient element configured to maintain tension in said cable, wherein the brake device is configured to prevent release of said cable so as to fix the foot structure relative to the shank structure during the swing phase of the gait cycle.

17. The lower extremity orthosis of claim 1 comprising, in combination, at least two of the knee orthosis, hip orthosis and ankle orthosis.

18. A method of using a lower extremity orthosis coupled across at least one joint of a person for gait assistance, with the lower extremity orthosis including a thigh orthosis including left and right, interconnected thigh structures configured to be coupled to the person and a single actuator, and one or more of: a) a knee orthosis including a waist link configured to be coupled to the person, a thigh link, a shank link configured to be coupled to the person, a knee joint and a torque generator, with said thigh link being rotatably connected both to said waist link at a hip joint and at the knee joint, said shank link being rotatably connected at the knee joint; b) a hip orthosis including the thigh link, the waist link, and an actuator, with said thigh link and said waist link being configured to be coupled to the person, said thigh link being rotatably connected to said waist link at the hip joint; and c) an ankle orthosis including a shank structure configured to couple to a shank of the person, a foot structure configured to couple to a foot of the person, and a brake device, said shank structure and said foot structure being interconnected, said method comprising:

when employing the knee orthosis, exerting a torque, with the torque generator, about the knee joint resulting in flexion or extension of a leg of the person, with forces generated by the torque generator being reacted at said waist link and the shank link;

utilizing the single actuator to drive the left and right thigh structures equally and in opposite directions, wherein the opposite directions include an anterior direction and a posterior direction;

when employing the hip orthosis, providing a force with said actuator of the hip orthosis on the thigh link during late stance and early swing; and when employing the ankle orthosis, preventing foot drop of the foot during a swing phase of a gait cycle through the brake device.

19. The method of claim 18 wherein the knee orthosis is employed, with the knee orthosis further including a foot link rotatably connected to the shank link at an ankle, wherein the forces generated by the torque generator are also reacted at the foot link.

20. The method of claim 18, wherein utilizing the single actuator includes activating a motor to shift a spline connection interconnecting the left and right thigh structures.

21. The method of claim 20, wherein utilizing the single actuator also causes movement at least one universal joint provided between the interconnected thigh structures.

22. The method of claim 18, said method further comprising sensing thigh position information for regulating the single actuator.

23. The method of claim 18, said method further comprising transferring forces between the left and right thigh structures through a link extending across a body of the person.

24. The method of claim 23, further comprising: rotating the single actuator concentric with a hip pivot.

25. The method of claim 18, wherein the hip orthosis is employed, said method further comprising creating a resilient biasing between the waist link and the thigh link.

26. The method of claim 25, further comprising:

creating the resilient biasing includes abutting a spring resilient element with a stop at small hip flexion angles; and disengaging the spring resilient element from the stop at larger angles.

27. The method of claim 18, wherein the ankle orthosis is employed, said method further comprising activating the brake device to limit pivoting movement of the foot structure relative to the shank structure.

28. The method of claim 27, further comprising: preventing relative pivoting movement between the foot and shank structures upon detecting when the foot structure engages a supporting ground surface.

29. The method of claim 27, wherein activating the brake device includes preventing release of a cable extending between the shank structure and the foot structure so as to fix the foot structure relative to the shank structure during the swing phase of the gait cycle.

30. The method of claim 18, comprising employing at least two of the knee orthosis, hip orthosis and ankle orthosis.

* * * * *